US006106728A

United States Patent [19]

Iida et al.

[11] Patent Number: 6,106,728

[45] Date of Patent: Aug. 22, 2000

[54] SLURRY RECYCLING SYSTEM AND METHOD FOR CMP APPARATUS

[76] Inventors: Shinya Iida; Akitoshi Yoshida, both of Hayakawa 2647, Ayase-shi, Kanagawa-ken, Japan

[21] Appl. No.: 09/103,653

[22] Filed: Jun. 23, 1998

[30] Foreign Application Priority Data

Jun. 23, 1997 [JP] Japan ..... 9-183073

[51] Int. Cl.[7] ..... B24B 1/00; B24B 57/02; H01L 21/00

[52] U.S. Cl. ..... 210/743; 210/663; 210/669; 210/681; 210/688; 210/739; 210/96.1; 210/167; 210/196; 210/266; 210/416.1; 451/54; 451/60; 451/287; 451/446; 438/692; 438/693

[58] Field of Search ..... 210/743, 739, 210/96.1, 167, 196, 416.1, 266, 681, 669, 663, 688; 451/54, 60, 287, 446; 438/692, 693; 134/902

[56] References Cited

U.S. PATENT DOCUMENTS 5,664,990 9/1997 Adams .

5,932,486 8/1999 Cook et al. .

FOREIGN PATENT DOCUMENTS 3-40537 8/1991 Japan .
7-221058 8/1995 Japan .
7-316846 12/1995 Japan .
8-321479 12/1996 Japan .

*Primary Examiner*—Thomas M. Lithgow
*Attorney, Agent, or Firm*—Snell & Wilmer, LLP

[57] ABSTRACT

A slurry recycling system for a CMP apparatus includes a flow path through which a slurry used in the CMP apparatus flows. A first filter is disposed in the flow path for filtering out foreign matter of a particle size of more than 0.5 microns mixed in said slurry. A second filter is preferably disposed in the flow path at a location upstream of and away from the first filter for filtering out foreign matter of a particle size of more than 10 microns mixed in said slurry. Preferably, provisions are made for a concentration adjuster for adjusting the concentration of abrasives in said slurry to substantially an initial value before use, and a pH adjuster for adjusting the pH of said slurry to substantially an initial pH value before use.

36 Claims, 4 Drawing Sheets

SLURRY RECYCLING SYSTEM AND METHOD FOR CMP APPARATUS

BACKGROUND OF THE INVENTION

1. Field of the Invention

The present invention relates to a slurry recycling system and method for a chemical mechanical polishing (hereinafter simply referred to as CMP) apparatus for recycling a slurry used when polishing workpieces such as wafers and the like in a CMP apparatus.

2. Description of the Related Art

FIG. 4 is a schematic view of the configuration of a CMP apparatus known to the inventors.

As shown in FIG. 4, the CMP apparatus is provided with a surface plate 100 on the surface of which is attached a polishing pad 101, and a carrier 200 for holding a wafer W.

The wafer W is pressed against the top of the polishing pad 101 by the carrier 200. In this state, the surface plate 100 and the carrier 200 are caused to rotate relative to each other by virtue of an unillustrated drive means such as an electric motor. Slurry S from a slurry feed apparatus 300 is continuously supplied to the top of the polishing pad 101, so that the precision of polishing and polishing rate of the wafer W can be improved.

The slurry S used for the polishing of the wafer W is for example slurry containing fumed silica for polishing the interlayer insulating film of the wafer W or slurry containing alumina for polishing a metal film. The former is an alkali slurry comprising a predetermined concentration of silica dispersed uniformly in pure water and held at a pH of about "11", while the latter is a slurry comprising an oxidizing agent for oxidizing the metal dissolved in pure water and held at a pH of about "2" to "4".

The slurry is selected depending on whether an interlayer insulating film of the wafer W is to be polished or a metal film is to be polished. Whatever the case may be, a desired polishing rate can be attained by maintaining the concentration of the abrasives of silica etc. and the pH at predetermined values.

The slurry used for polishing in a CMP apparatus, however, has contained silicate ions created and dissolved therein during the polishing and therefore changed in pH from its original or initial state. Further, the concentration of the abrasives after polishing has changed and therefore repeated use thereof is not possible.

In particular, the slurry S after polishing has mixed in it polishing dross of the polishing pad 101, dressing dross, and other large and small foreign matter. If such a slurry S is reused as it were, the wafer W would be scratched and the wafer W could no longer be used.

Therefore, in the past, as shown in FIG. 4, a waste liquid receiver 110 was placed around the surface plate 100. The slurry S discharged due to the centrifugal force of the surface plate 100 was received by the waste liquid receiver 110, then stored in a waste liquid tank 120, and finally completely disposed of.

The slurry S actually used for polishing a wafer W, however, is just about 5 percent of the total amount of slurry S supplied.

Therefore, the large remaining 95 percent of the slurry S which could be reused if the slurry S actually used for the polishing were not mixed in with it is disposed of. An extremely large amount of the slurry S has therefore been wasted.

SUMMARY OF THE INVENTION

The present invention is intended to obviate the above-mentioned problems and has for its object to provide a novel and improved slurry recycling system and method for a CMP apparatus, which are capable of reducing the cost of polishing work by enabling a used slurry to be restored to its original properties and be reused.

According to a first aspect of the present invention, there is provided a slurry recycling system of a CMP apparatus comprising: a flow passage means through which a slurry used in the CMP apparatus flows; a first filtering means, disposed in the flow passage means, for filtering out foreign matter of a particle size of more than 0.5 microns mixed in the slurry; and a second filtering means, disposed at a location upstream of and away from the first filtering means, for filtering out foreign matter of a particle size of more than 10 microns mixed in the slurry.

In a preferred form of the first aspect of the invention, the slurry recycling system for a CMP apparatus further comprises a concentration adjusting means for adjusting the concentration of abrasives in the slurry to substantially an initial value before use.

In another preferred form of the first aspect of the invention, the slurry recycling system for a CMP apparatus further comprises a pH adjusting means for adjusting the pH of the slurry to substantially an initial pH value before use.

In accordance with a second aspect of the present invention, there is provided a slurry recycling system for a CMP apparatus comprising: a flow passage means through which a slurry used in the CMP apparatus flows; a first filtering means, disposed in the flow passage means, for filtering out foreign matter of a particle size of more than 0.5 microns mixed in the slurry; and a concentration adjusting means for adjusting the concentration of abrasives in the slurry to substantially an initial value before use.

In a preferred form of the second aspect of the invention, the slurry recycling system for a CMP apparatus further comprises a pH adjusting means for adjusting the pH of the slurry to substantially an initial pH value before use.

In accordance with a third aspect of the present invention, there is provided a slurry recycling system for a CMP apparatus comprising: a flow passage means through which a slurry used in the CMP apparatus flows; a first filtering means, disposed in the flow passage means, for filtering out foreign matter of a particle size of more than 0.5 microns mixed in the slurry; and a pH adjusting means for adjusting the pH of the slurry to substantially an initial pH value before use.

In a preferred form of the third aspect of the invention, the slurry recycling system for a CMP apparatus further comprises a second filtering means, disposed at a location upstream of and away from the first filtering means, for filtering out foreign matter of a particle size of more than 10 microns mixed in the slurry.

In a further preferred form of the first, or second, or third aspect of the present invention, the pH adjusting means comprises a pH adjuster which adjusts the pH value by adding an alkaline agent to the slurry when the pH of the slurry is lower than the initial pH value before use and adding an acidic agent to the slurry when the pH of the slurry is higher than the initial pH value before use.

In a still further preferred form of the first, or second, or third aspect of the present invention, the pH adjusting means comprises: a pH adjuster which adjusts the pH value by adding an alkaline agent to the slurry when the pH of the slurry is lower than the initial pH value before use and adding an acidic agent to the slurry when the pH of the slurry is higher than the initial pH value before use; and a deionizer, disposed at a location upstream of the pH adjuster, for removing the ions produced in the slurry during use.

In a yet further preferred form of the first, or second, or third aspect of the present invention, the slurry is any one selected from the group consisting of: a slurry comprising a fumed particulate powder of silica, alumina, zirconia, ceria, titania, or other metal oxides dispersed colloidally in one of water and an organic solvent; a slurry comprising colloidal silica, colloidal alumina, colloidal zirconia, colloidal, ceria, or colloidal titania produced from at least one of an aqueous solution of an inorganic metal salt or a solution of an organic metal salt capable of producing silica, alumina, zirconia, ceria, titania; and a slurry comprising a sintered powder of alumina, zirconia, ceria, manganese oxide, or other metal oxides dispersed colloidally in one of water and an organic solvent.

In accordance with a fourth aspect of the present invention, there is provided a slurry recycling method for a CMP apparatus comprising: a first filtering step for filtering out foreign matter of less than a particle size of more than 0.5 microns mixed in a slurry used in the CMP apparatus; and a second filtering step, carried out before the first filtering step, for filtering out foreign matter of a particle size of more than 10 microns mixed in the slurry.

In a preferred form of the fourth aspect of the invention, the slurry recycling method of a CMP apparatus further comprises a concentration adjusting step for adjusting the concentration of abrasives in the slurry to substantially an initial value before use.

In another preferred form of the fourth aspect of the invention, the slurry recycling method of a CMP apparatus further comprises a pH adjusting step for adjusting the pH of the slurry to substantially an initial pH value before use.

In accordance with a fifth aspect of the present invention, there is provided a slurry recycling method for a CMP apparatus comprising: a first filtering step for filtering out foreign matter of less than a particle size of more than 0.5 microns mixed in a slurry used in the CMP apparatus; and a concentration adjusting step for adjusting the concentration of abrasives in the slurry to substantially an initial value before use.

In a preferred form of the fifth aspect of the invention, the slurry recycling method of a CMP apparatus further comprises a pH adjusting step for adjusting the pH of the slurry to substantially an initial pH value before use.

In accordance with a six aspect of the present invention, there is provided a slurry recycling method for a CMP apparatus comprising: a first filtering step for filtering out foreign matter of a particle size of more than 0.5 microns mixed in a slurry used in the CMP apparatus; and a pH adjusting step for adjusting the pH of the slurry to substantially an initial pH value before use.

In a preferred form of the fifth aspect of the invention, the slurry recycling method of a CMP apparatus further comprises a second filtering step, carried out before the first filtering step, for filtering out foreign matter of a particle size of more than 10 microns mixed in the slurry.

In a further preferred form of the fourth, or fifth, or sixth aspect of the invention, the pH adjusting step adjusts the pH value of the slurry by adding an alkaline agent to the slurry when the pH of the slurry is lower than the initial pH value before use and adding an acidic agent to the slurry when the pH of the slurry is higher than the initial pH value before use.

In a still further preferred form of the fourth, or fifth, or sixth aspect of the invention, the pH adjusting step removes the ions produced in the slurry during use, then adjusts the pH value of the slurry by adding an alkaline agent to the slurry when the pH of the slurry is lower than the initial pH value before use and adding an acidic agent to the slurry when the pH of the slurry is higher than the initial pH value before use.

In a yet further preferred form of the fourth, or fifth, or sixth aspect of the invention, the slurry is any one selected from the group consisting of: a slurry comprising a fumed particulate powder of silica, alumina, zirconia, ceria, titania, or other metal oxides dispersed colloidally in one of water and an organic solvent; a slurry comprising colloidal silica, colloidal alumina, colloidal zirconia, colloidal ceria, or colloidal titania produced from at least one of an aqueous solution of an inorganic metal salt or solution of an organic metal salt capable of producing silica, alumina, zirconia, ceria, titania; and a slurry comprising a sintered powder of alumina, zirconia, ceria, manganese oxide, or other metal oxides dispersed colloidally in one of water and an organic solvent.

The above and other objects, features and advantages of the present invention will become clearer from the following description of preferred embodiments of the invention given with reference to the attached drawings.

DESCRIPTION OF THE PREFERRED EMBODIMENTS

In the following, preferred embodiments of the present invention will be described in detail while referring to the accompanying drawings.

First Embodiment

Figure 1:
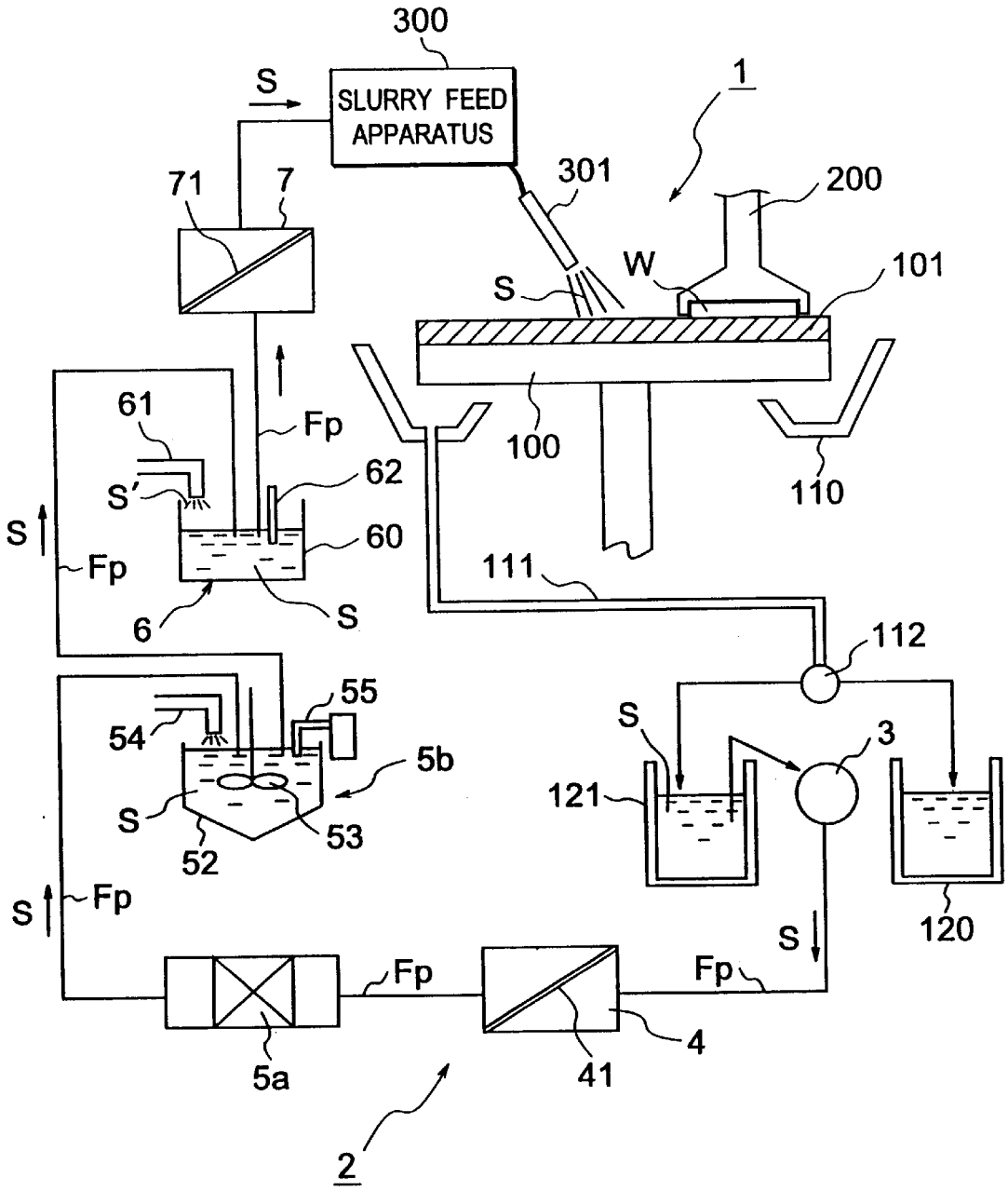
FIG. 1 is a schematic view of an example of application of the slurry recycling system for a CMP apparatus according to a first embodiment of the present invention to a single CMP apparatus.

FIG. 1 is a schematic view of an example of application of the slurry recycling system for a CMP apparatus according to a first embodiment of the present invention to a single CMP apparatus.

Figure 4:
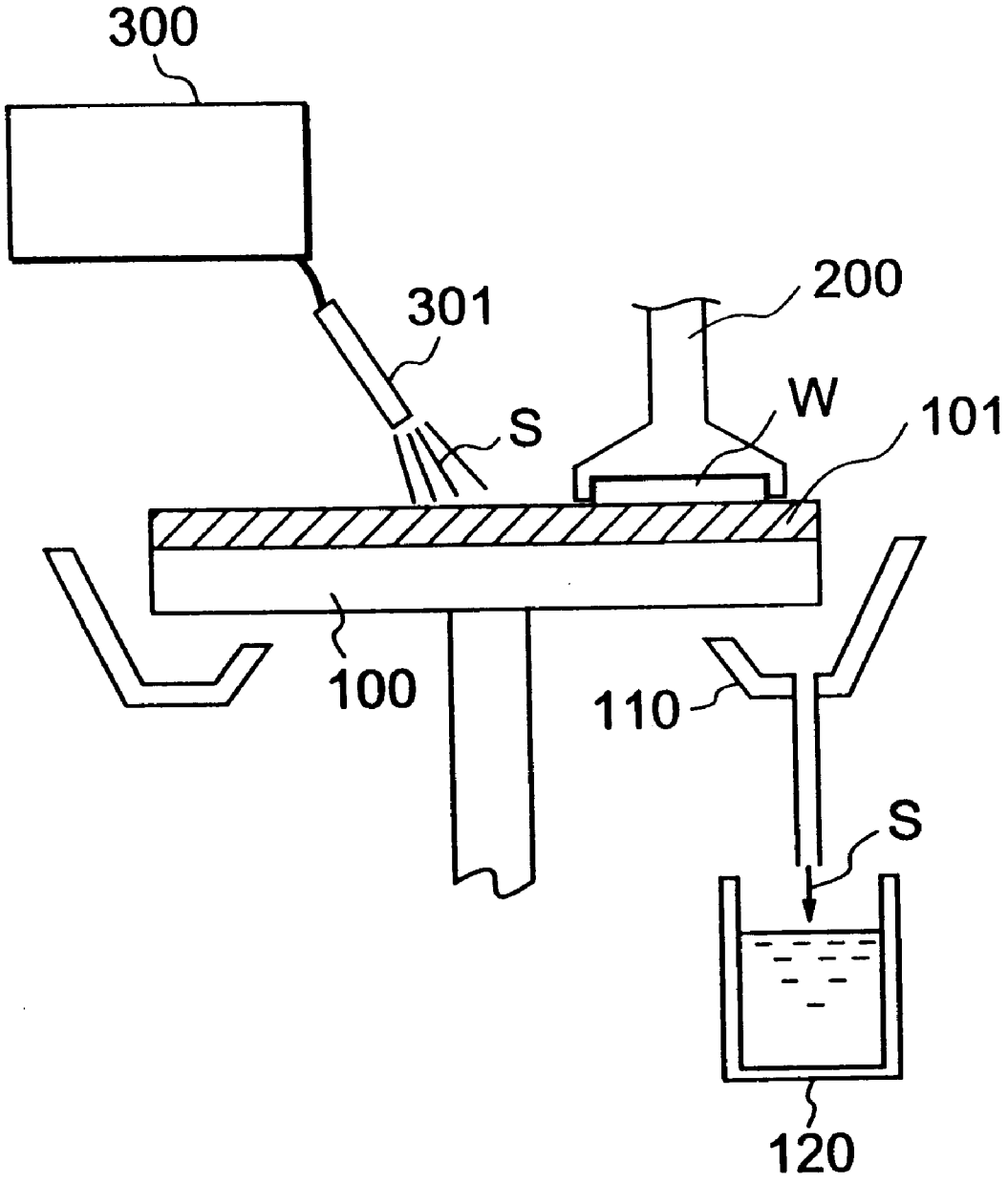
FIG. 4 is a schematic view of the configuration of a CMP apparatus according to the related art.

Note that parts the same as those shown in FIG. 4 are given the same reference numerals in the following explanation.

In FIG. 1, reference numeral 1 is a CMP apparatus and reference numeral 2 is a recycling system.

The CMP apparatus 1 is the same as the CMP apparatus shown in FIG. 4, except for the provision of a three-way cock valve 112 at the outlet of a pipe 111 communicating with a waste liquid receiver 110. By adjusting the valve 112, it is possible to store the used slurry S in a storage tank 121 or discharge the slurry S after cleaning by a surface plate 100 and comprised almost entirely of water into a waste liquid tank 120.

Here, to facilitate understanding, the slurry S used in the CMP apparatus 1 will be assumed to be fumed silica type slurry.

That is, a predetermined concentration of fumed $SiO_2$ abrasive (silica) is added to an alkaline solution, adjusted to a pH of "11" or so by dissolving potassium hydroxide (KOH) or ammonia ($NH_3$), to make a colloidal slurry S (or $SiO_2$ abrasives are added to water to form a colloid, then potassium hydroxide or ammonia is added to make the slurry S a pH of about 11). This is supplied from a nozzle 301 of a slurry feed apparatus 300 onto the surface plate 100 on which a polishing pad 101 is attached while causing a carrier 200 holding a workpiece in the form of a wafer W and the surface plate 100 to rotate relative to each other and polish the wafer W. The slurry S discharged to the waste liquid receiver 110 and passing through a pipe 111 passes through a valve 112 to be stored in a storage tank 121.

Note that when dispersing a metal oxide powder in water to make a slurry, it is also possible to add an acid or alkali to adjust the pH in advance or later.

The recycling system 2 is a technique enabling reuse of the slurry S stored in the storage tank 121 in this way to be reused by the CMP apparatus 1. The recycling system 2 comprises a flow passage means in the form of a flow passage or piping Fp, a second filtering means in the form of a filter 4, a deionizer 5*a*, a pH adjusting means in the form of a pH adjuster 5*b*, a concentration adjusting means in the form of a concentration adjusting tank 6, and a first filtering means in the form of a filter 7 successively arranged in the flow passage Fp.

The flow passage Fp serves to successively guide the slurry S in the storage tank 121 pumped out by a pump 3 to the filter 4, the deionizer 5*a*, the pH adjuster 5*b*, the concentration adjusting tank 6, and the filter 7 using a separate pump (not shown), etc.

The filter 4 serves to filter out foreign matter having a particle size of at least 10 microns mixed in the slurry. Specifically, it is a cartridge type filter having a mesh 41 of 10 microns to 200 microns.

That is, by making the slurry S from the storage tank pass through the mesh 41 of the filter 4, it is possible to remove the contaminants of the polishing pad 101, the polishing dross, the dressing dross, and other foreign matter mixed in at the time of polishing by the CMP apparatus and the coagulated slurry of a large particle size by making them deposit on the mesh 41.

The deionizer 5*a* and the pH adjuster 5*b* serve to restore the pH of the slurry S roughly filtered by the filter 4 to the pH value before use, i.e., the initial pH value.

The deionizer 5*a* comprises a cartridge type ion exchange resin, an ion exchange film or the like for removing the excess ions present in the slurry S having passed through the filter 4. The deionizer 5*a* is attached at the discharge side of the filter 4.

Specifically, when the wafer W polished by the CMP apparatus 1 is a silicon wafer and the like, silicate ions etc. are sometimes dissolved in the slurry S from the wafer W during the polishing, thus changing the pH of the slurry S from "11" to "9.5" or "12", etc. Further, if excess ions are dissolved in the slurry S, the slurry S is liable to coagulate. Therefore, the excess ions are removed from the slurry S by the deionizer 5*a* to make the pH thereof near about "11" and maintain the colloidal state of the slurry S.

The pH adjuster 5*b* serves to restore the pH of the slurry S to substantially completely the initial pH value when there is excessive or insufficient deionization in the deionizer 5*a*. The pH adjuster 5*b* comprises a tank 52, an agitator 53, a feed pipe 54 and a pH meter 55.

That is, the slurry S from the deionizer 5*a* is stored in the tank 52 by way of the flow passage Fp connected to the discharge side of the deionizer 5*a*. An acidic agent or alkaline agent is fed from the feed pipe 54 to the inside of the slurry S while being agitated by the agitator 53.

More specifically, a pH meter 55 measures the pH of the slurry S in the tank 52. When the measured pH value is lower than the initial pH value, that is, when the slurry is toward the acid side, potassium hydroxide, ammonia, amine substances, quaternary ammonium hydroxide, or other alkaline agents are added to the slurry S from the feed pipe 54. On the contrary, when the measured pH value is higher than the initial pH value, that is, when the slurry is toward the alkali side, hydrochloric acid, nitric acid, hydrogen peroxide, or other acidic agents are added to the slurry S. Further, when the value measured by the pH meter 55 reaches substantially "11", the feed of the acidic agent and the like is stopped and the slurry S in the tank 52 is sent to the concentration adjusting tank 6 by a pump (not shown), etc.

The concentration adjusting tank 6 serves to restore the concentration of the abrasive such as silica in the slurry S to the initial concentration. The concentration adjusting tank 6 has a tank body 60, a feed pipe 61, and a concentration meter 62. Specifically, the concentration of silica in the slurry S falls along with the dressing during the polishing work of the CMP apparatus 1, rinsing, etc., so the concentration of silica is restored by the concentration adjusting tank 6.

More specifically, the slurry S sent from the pH adjuster 5*b* is stored in the tank body 60 where a new slurry S' containing a high concentration of silica in a colloidal state is added from the feed pipe 61 to the slurry S in the tank body 60 to raise the concentration of the slurry S. In parallel with this, changes in the concentration of the slurry S are measured by the concentration meter 62. When the measured value reaches the initial silica concentration of the slurry S, the supply of the slurry S' is stopped and the slurry S in the tank body 60 is sent to the filter 7 by an unillustrated pump or the like.

The filter 7 serves to filter out the small foreign matter having a particle size of more than 0.5 microns mixed in the slurry S sent from the concentration adjusting tank 6 and the somewhat large coagulated slurry. Specifically, it is a cartridge type filter having a mesh 71 of 0.5 microns to 10 microns.

That is, the majority of the foreign matter mixed in the slurry S is removed at the time of passage through the filter 4, but small foreign matter of less than 10 microns size sometimes remains. If this slurry S is reused, countless small scratches will be formed on the wafer W. Therefore, the filter 7 is used to substantially completely remove the foreign matter and substantially completely prevent the scratching of the wafer W at the time of reuse.

Note that the structure of the filter 7 need not be a simple mesh structure. It is also possible for the filter 7 to have a double structure comprising a deep filter portion and a surface filter portion.

That is, the deep filter portion can be formed of a layer of a nonwoven fabric, sponge, fabric, porous body, a sand layer, or other filter materials having pores of 0.5 to 10 microns, and after the deep filter portion thus formed there is disposed the surface filter portion which is formed of wire mesh, resin mesh, membrane, fabric, paper (filter paper), or other filter material with a mesh size of 0.5 to 10 microns. With this structure, at the deep filter portion, it is possible to initially roughly filter the slurry and then finely filter it along with the passage of time. Further, it is possible to completely filter out substances having a size of more than 0.5 microns among the foreign matter having passed through the deep filter portion.

To the discharge side of the filter 7, there is connected an inlet port of the flow passage Fp such as piping, an outlet port of which is connected to the slurry feed apparatus 300.

Next, an explanation will be given of the operation of the recycling system of the present embodiment.

In this regard, it is to be noted that the operation of the recycling system concretely achieves the steps of the recycling method according to the present invention.

When a workpiece in the form of a silicon wafer W by means of the CMP apparatus 1, the wafer W is urged or pressed against the polishing pad 101 of the rotating surface plate 100 by means of the rotating carrier 200. The fumed silica type slurry S is continuously fed from the slurry feed apparatus 300 to the surface plate 100.

Thus, the interlayer insulating film of the wafer W is planarized or fattened and made uniform by the slurry S present between the wafer W and the polishing pad 101.

At this time, the slurry S on the surface plate 100 is discharged into the waste liquid receiver 110 by the centrifugal force of the surface plate 100 and stored in the storage tank 121 through the pipe 111 and the valve 112.

The slurry S stored in the storage tank 121 is fed to the flow passage Fp by the pump 3. First, the filter 4 removes the large polishing dross and other foreign matter of over 10 microns particle size mixed in the slurry S (second filtering step).

Subsequently, the slurry S is passed through the deionizer 5*a* so that the silicate ions and other ions dissolved in the slurry S are removed by the deionizer 5*a*. The slurry S thus filtered is stored in the tank 52 of the pH adjuster 5*b*.

When, at this time, the ions in the slurry s have been substantially completely removed by the deionizer 5*a* and the pH value of the slurry S indicated by the pH meter 55 is substantially "11", the slurry S in the tank 52 is sent to the tank body 60 of the concentration adjusting tank 6 as it is. Contrary to this, when the deionization at the deionizer 5*a* was excessive or insufficient and the pH value indicated by the pH meter 55 is considerably off from "11", an alkaline agent such as ammonia or an acidic agent such as hydrochloric acid is added to the slurry S from the feed pipe 54 to the slurry S in the tank 52 so as to adjust the pH value thereof. When the pH value indicated by the pH meter 55 becomes substantially "11", the supply of the alkaline or acidic agent is stopped and the slurry S in the tank 52 is sent to the tank body 60 (pH adjusting step).

When the slurry S is stored in the tank body 60 of the concentration adjusting tank 6, the concentration of the silica is measured and displayed by the concentration meter 62. When the silica concentration is smaller than the initial concentration, a high concentration slurry S' is added from the feed pipe 61 to the tank body 60 until the concentration meter 62 shows the substantially initial value. When the initial value is shown, the supply of the slurry S' from the feed pipe 61 is stopped and the slurry S in the tank body 60 is sent to the filter 7 (concentration adjusting step). This prevents fluctuation of the polishing rate due to changes in the viscosity of the slurry and enables stable polishing work.

Further, the small foreign matter of a particle size of less than 10 microns (i.e., from about 0.5 microns to about 10 microns) mixed in the slurry S is removed by the filter 7 and the slurry S thus filtered is sent to the slurry feed apparatus 300 (first filtering step).

In this manner, the slurry S from which the intermixed foreign matter has been removed and with its pH and the concentration of silica restored to substantially the initial values is fed back to the slurry feed apparatus 300 and resupplied to the surface plate 100.

At this time, the foreign matter in the slurry S is substantially completely removed, so even if this slurry S is used, the wafer W will not be scratched. Further, since the pH and the concentration of silica in the slurry S have been restored to substantially the initial values, the polishing rate of the wafer W is substantially unchanged from before use and stable polishing is possible.

Here, it is to be noted that after the end of the polishing by the CMP apparatus 1, water is sprayed over the surface plate 100 and the carrier 200 to clean them. The slurry S deposited on them is discharged to the waste liquid receiver 100, stored in the waste liquid tank 120 through the pipe 111 and the valve 112, and then disposed of.

According to the recycling system of this embodiment, it is possible to reuse the used slurry S without disposing of it, so it is possible to eliminate the wasteful consumption of the slurry S and as a result lower the cost of polishing work.

Second Embodiment

Figure 2:
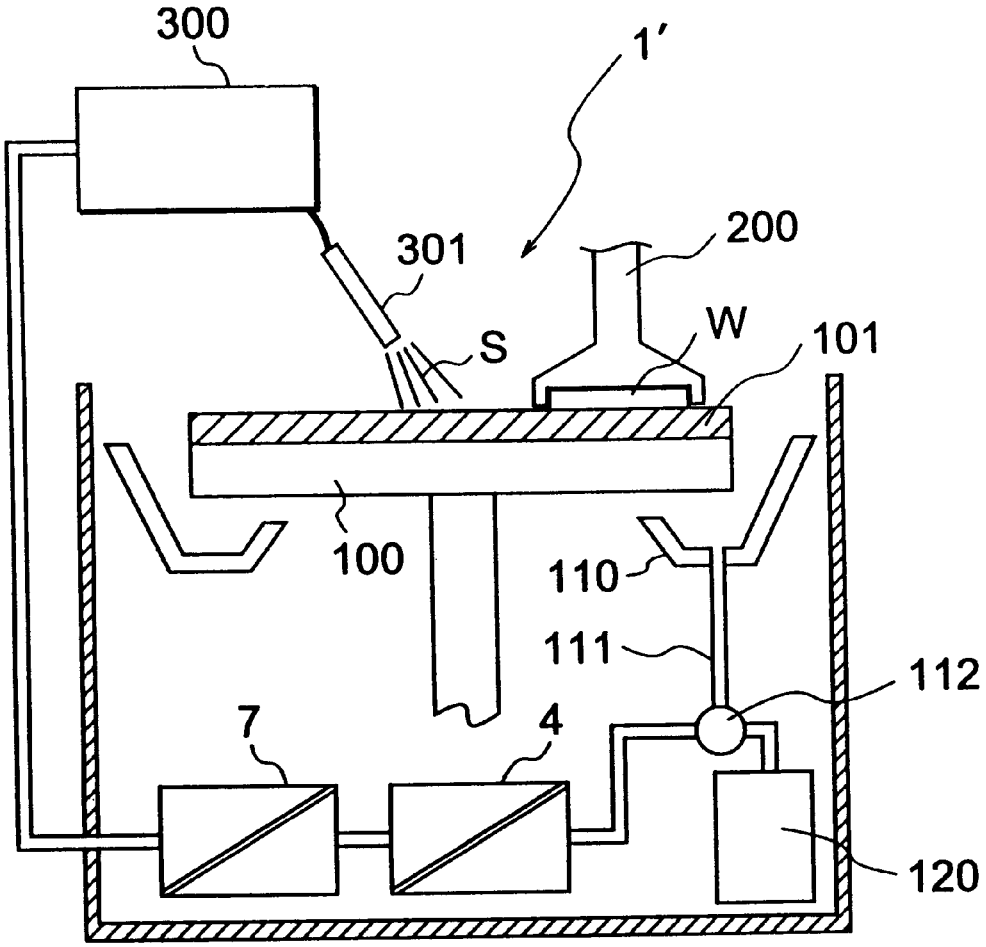
FIG. 2 is a schematic view of an example of application of the slurry recycling system for a CMP apparatus according to a second embodiment of the present invention to a single CMP apparatus.

FIG. 2 is a schematic view of an example of application of the slurry recycling system for a CMP apparatus according to a second embodiment of the present invention to a single CMP apparatus.

Note that parts the same as those shown in FIG. 1 are given the same reference numerals.

The CMP apparatus 1' is configured with piping for feeding back the slurry S from the valve 112 to the slurry feed apparatus 300 and with filters 4 and 7 disposed successively in the piping.

With this arrangement, the slurry S discharged into the waste liquid receiver 110 flows through the valve 112 to the filters 4 and 7. The filters 4 and 7 remove the large and small foreign matter mixed in it, then the slurry S is fed to the slurry feed apparatus 300 and is automatically reused.

Therefore, since there is no adjustment of the pH or adjustment of the concentration in this recycling system, the number of times of reuse of the slurry S becomes smaller than the recycling system of the first embodiment, but it is possible to reduce the cost through simplification of the system. Further, since the slurry S is automatically recycled, labor can be reduced in the work.

The rest of the configuration, operation and effect of the second embodiment are the same as those of the first embodiment, so a further description thereof will be omitted.

Here, it is to be noted that the present invention is not limited to the above embodiments, but various modifications and changes thereof are possible within the spirit or scope of the invention as defined in the appended claims.

Figure 3:
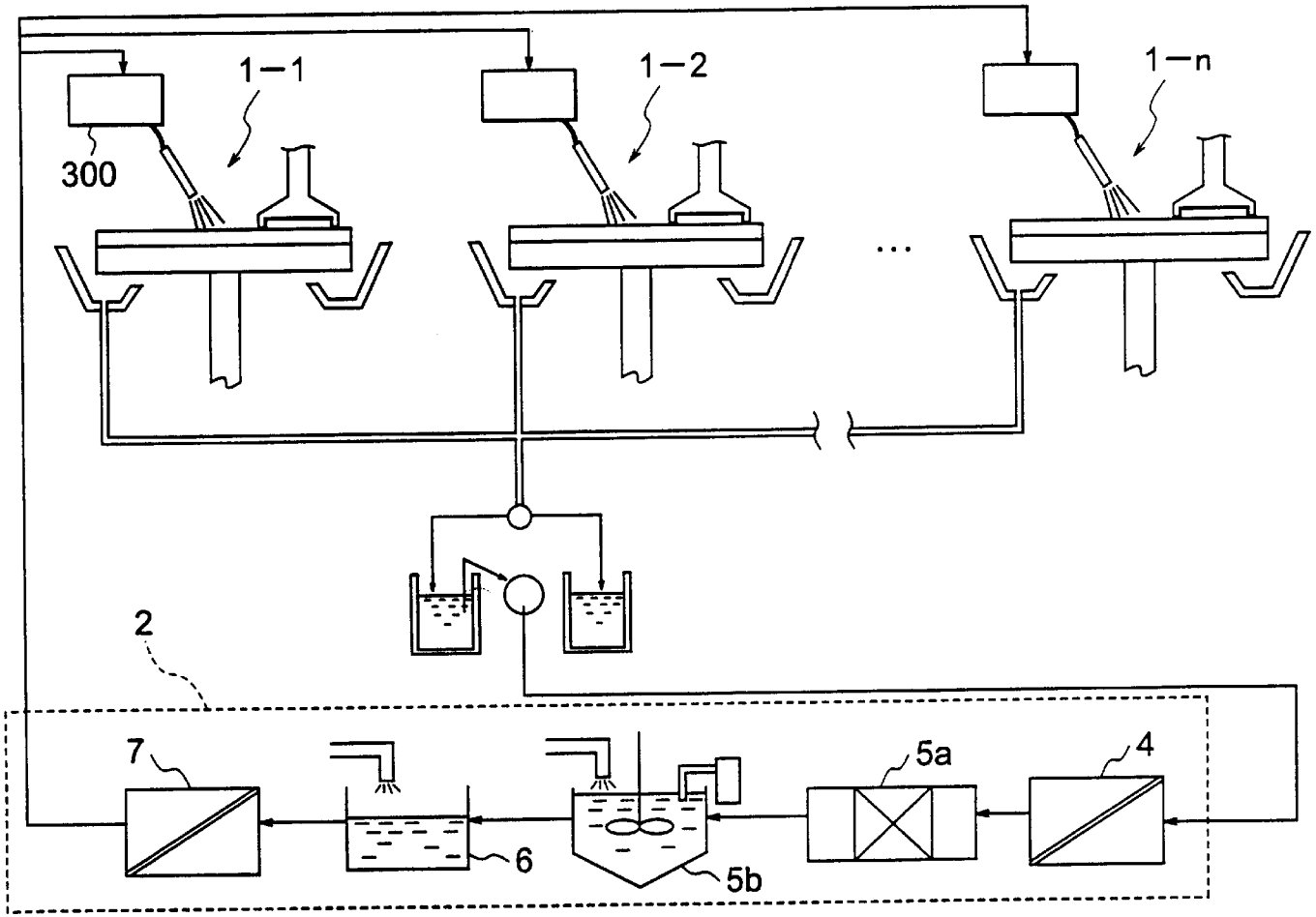
FIG. 3 is a schematic view of a modification of the above embodiments.

For example, although in the above-mentioned first embodiment, the present invention has been shown as being applied to a single CMP apparatus 1 in which the slurry S is able to be substantially restored to its original or initial state, the recycling system of this embodiment is considerably large in size. Therefore, in actual use, as shown in FIG. 3, it is preferable to use a single system 2 to feed back slurry to a large number of CMP apparatuses 1—1 to 1-n.

Further, it is possible to store the used slurry S produced by a large number of CMP apparatuses 1—1 to 1-n in a single tank, restore the slurry S in the tank by a recycling system installed at a separate location, then distribute it again to the CMP apparatuses 1—1 to 1-n for reuse.

In the first embodiment, the fumed silica type slurry used for polishing the interlayer insulating film of the wafer W was used as the slurry S for recycling, but it is also possible to similarly recycle even fumed metal oxide slurry, colloidal slurry, or slurry comprising fine particles of sintered powder of metal oxides dispersed in water or an organic solvent. Some examples for such a slurry are fumed alumina slurry, zirconia solated slurry, colloidal silica slurry produced from an inorganic metal aqueous solution, colloidal zirconia slurry and the like.

Further, in the above-mentioned first embodiment, the filter 4, the deionizer 5*a* and the pH adjuster 5*b*, the concentration adjusting tank 6, and the filter 7 were disposed in the flow passage Pf in this order, but the order of their dispositions is not limited to this. The order for removing the foreign matter in the slurry S is preferably to first remove the large foreign matter by the filter 4 and then remove the remaining small foreign matter by the filter 7 so as to reduce the load on the filter 7 as much as possible.

Further, the present invention does not require all of the filter 4 and the filter 7. Therefore, the invention may include a configuration provided with only the concentration. adjusting tank 6 and the filter 7, another configuration provided with only the pH adjuster 5*b* and the filter 7, and a further configuration provided with only the pH adjuster 5*b*, the concentration adjusting tank 6, and the filter 7.

Here, it is considered that the order of priority for devices to be added to the filter 4 or the filter 7 is the concentration adjusting tank 6 and the pH adjuster 5*b*.

Further, while the filters 4 and 7 were used as the first and second filtering means, the present invention is not limited to these. It is also possible to use all known art or techniques able to remove foreign matter of a particle size of over 10 microns or under 10 microns.

Further, while the deionizer 5*a* and the pH adjuster 5*b* were used as the pH adjusting means, it is also possible to use all known art or techniques able to adjust the pH of the slurry S.

Further, while a device having the tank body 60 and the feed pipe 61 was used as the concentration adjusting means, it is also possible to use all known art or techniques able to adjust the concentration of abrasive in the slurry S. For example, it is possible to pass the slurry S from the pH adjuster 5*b* through a ceramic filter or plastic or resin filter having a semipermeable membrane and concentrate the slurry S by these.

Further, while just two filters 4 and 7 were provided in the above-mentioned second embodiment, it is also possible to provide between these filters a concentration adjusting means comprising a ceramic filter etc., and/or the deionizer 5*a*, etc.

As explained in detail above, according to the present invention, by providing the second filtering means, it is possible to filter out polishing dross and other foreign matter and hence prevent scratching of a workpiece such as a wafer at the time of reuse of the slurry, so it is possible to reuse the same slurry a number of times and as a result reduce the costs of the polishing work.

Further, by providing the concentration adjusting means, it is possible to restore the concentration of abrasive in the slurry to substantially the concentration before use, so not only is it possible to prevent scratching of the workpiece, but also it is possible to restore the polishing properties of the slurry to substantially the properties before use. As a result, it is possible to increase the number of times of reuse of the same slurry and thereby further reduce the cost of the polishing work.

Further, by provision of the pH adjusting means, it is possible to not only remove the foreign matter and restore the concentration of abrasive in the slurry, but also restore the pH of the slurry to substantially the pH value before use, so substantially the same polishing rate is achieved by reuse of the slurry as with a new slurry.

While the invention has been described by reference to specific embodiments chosen for purposes of illustration, it should be apparent that numerous modifications could be made thereto by those skilled in the art without departing from the basic concept and scope of the invention.

What is claimed is:

1. A slurry recycling system for a CMP apparatus comprising:

a flow passage means through which a slurry used in the CMP apparatus flows;

a first filtering means, disposed in said flow passage means, for filtering out foreign matter of a particle size of more than 0.5 microns mixed in said slurry;

a pH adjuster which adjusts the pH value by adding an alkaline agent to said slurry when the pH of said slurry is lower than the initial pH value before use and adding an acidic agent to said slurry when the pH of said slurry is higher than the initial pH value before use;

a deionizer, disposed at a location upstream of said pH adjuster, for removing ions produced in said slurry during use; and a slurry feed means for feeding said slurry to the CMP apparatus.

2. The slurry recycling system for a CMP apparatus as set forth in claim 1, further comprising a second filtering means, disposed at a location upstream of and away from said first filtering means, for filtering out foreign matter of a particle size of more than 10 microns mixed in said slurry.

3. The slurry recycling system for a CMP apparatus as set forth in claim 1, further comprising a concentration adjusting means for adjusting the concentration of abrasives in said slurry to substantially an initial value before use.

4. The slurry recycling system for a CMP apparatus as set fort in claim 3, further comprising a second filtering means, disposed at a location upstream of and away from said first filtering means, for filtering out foreign matter of a particle size of more than 10 microns mixed in said slurry.

5. The slurry recycling system for a CMP apparatus as set forth in claim 1 wherein said deionizer comprises an ion exchange resin.

6. The slurry recycling system for a CMP apparatus as set forth in claim 1 wherein said deionizer comprises an ion exchange film.

7. The slurry recycling system for a CMP apparatus as set forth in claim 1 wherein said slurry comprises a fumed particulate powder of silica alumina, zirconia, ceria, titania, or other metal oxides dispersed colloidally in one of water and an organic solvent.

8. The slurry recycling system for a CMP apparatus as set forth in claim 1 wherein said slurry comprises colloidal silica, colloidal alumina, colloidal zirconia, colloidal ceria, or colloidal titania produced from at least one of an aqueous solution of an inorganic metal salt or a solution of an organic metal salt capable of producing silica, alumina, zirconia, ceria, or titania.

9. A slurry recycling system for a CMP apparatus as set forth in claim 1 wherein said slurry comprises a sintered powder of alumina, zirconia, ceria, manganese oxide, or other metal oxides dispersed colloidally in one of water and an organic solvent.

10. A slurry recycling system for a CMP apparatus comprising:

a conduit through which a slurry used in the CMP apparatus flows;

a first filter coupled to said conduit for filtering out foreign matter of a particle size of more than 0.5 microns mixed in said slurry;

a pH adjuster which adjusts the pH value of said slurry by adding an alkaline agent to said slurry when the pH of said slurry is lower than the initial pH value before use and adding an acidic agent to said slurry when the pH of said slurry is higher than the initial value before use;

a deionizer, disposed at a location upstream of said pH adjuster, for removing the ions produced in said slurry during use; and a slurry feed for feeding said slurry to the CMP apparatus.

11. The slurry recycling system for a CMP apparatus as set forth in claim 10, further comprising a second filter, disposed at a location upstream of and away from said first filter, for filtering out foreign matter of a particle size of more than 10 microns mixed in said slurry.

12. The slurry recycling system for a CMP apparatus as set forth in claim 10, further comprising a concentration adjuster for adjusting the concentration of abrasives in said slurry to substantially an initial value before use.

13. The slurry recycling system for a CMP apparatus as set forth in claim 12, further comprising a second filter, disposed at a location upstream of and away from said first filter, for filtering out foreign matter of a particle size of more than 10 microns mixed in said slurry.

14. The slurry recycling system for a CMP apparatus as set forth in claim 10 wherein said deionizer comprises an ion exchange resin.

15. The slurry recycling system for a CMP apparatus as set forth in claim 10 wherein said deionizer comprises an ion exchange film.

16. The slurry recycling system for a CMP apparatus as set forth in claim 10 wherein said slurry comprises a fumed particulate powder of silica, alumina, zirconia, ceria, titania, or other metal oxides dispersed colloidally in one of water and an organic solvent.

17. The slurry recycling system for a CMP apparatus as set forth in claim 10 wherein said slurry comprises colloidal silica, colloidal alumina, colloidal zirconia, colloidal ceria, or colloidal titania produced from at least one of an aqueous solution of an inorganic metal salt or a solution of an organic metal salt capable of producing silica, alumina, zirconia, ceria, or titania.

18. The slurry recycling system for a CMP apparatus as set forth in claim 10 wherein said slurry comprises a sintered powder of alumina, zirconia, ceria, manganese oxide, or other metal oxides dispersed colloidally in one of water and an organic solvent.

19. A slurry recycling method for a CMP apparatus comprising:

a first filtering step for filtering out foreign matter of a particle size of more than 0.5 microns mixed in a slurry used in the CMP apparatus;

a deionizing step for removing ions produced in said slurry during use;

a pH adjusting step for adjusting the pH value of said slurry by adding an alkaline agent to said slurry when the pH of said slurry is lower than the initial pH value before use and adding an acidic agent to said slurry when the pH of said slurry is higher than the initial pH value before use; and a slurry feeding step for feeding said slurry to the CMP apparatus.

20. The slurry recycling method for a CMP apparatus as set forth in claim 19, further comprising a second filtering step carried out before said first filtering step for filtering out foreign matter of a particle size of more than 10 microns mixed with said slurry.

21. The slurry recycling method for a CMP apparatus as set forth in claim 19, further comprising a concentration adjusting step for adjusting the concentration of abrasives in said slurry to substantially an initial value before use.

22. The slurry recycling method for a CMP apparatus as set forth in claim 21, further comprising a second filtering step carried out before said first filtering step for filtering out foreign matter of a particle size of more than 10 microns mixed in said slurry.

23. The slurry recycling method for a CMP apparatus as set forth in claim 19 wherein said deionizing step comprises subjecting said slurry to an ion exchange resin.

24. The slurry recycling method for a CMP apparatus as set forth in claim 19 wherein said deionizing step comprises subjecting said slurry to an ion exchange film.

25. The slurry recycling method for a CMP apparatus as set forth in claim 19 wherein said slurry comprises a fumed particulate powder of silica, alumina, zirconia, ceria, titania or other metal oxides dispersed colloidally in one of water and an organic solvent.

26. The slurry recycling method of a CMP apparatus as set forth in claim 19 wherein said slurry comprises colloidal silica, colloidal alumina, colloidal zirconia, colloidal ceria, or colloidal titania produced from at least one of an aqueous solution of an inorganic metal salt or a solution of an organic metal salt capable of producing silica, alumina, zirconia, ceria or titania.

27. The slurry recycling method of a CMP apparatus as set forth in claim 19 wherein said slurry comprises a sintered powder of alumina, zirconia, ceria, manganese oxide, or other metal oxides dispersed colloidally in one of water and an organic solvent.

28. A slurry recycling system of a CMP apparatus comprising:

a flow passage means through which said slurry used in the CMP apparatus flows;

a first filtering means, disposed in said flow passage means, for filtering out foreign matter of a particle size of more than 0.5 microns mixed in a slurry;

a deionizer for removing the ions produced in said slurry during use; and a slurry feed means for feeding said slurry to the CMP apparatus.

29. The slurry recycling system for a CMP apparatus as set forth in claim 28, further comprising a second filtering means, disposed at a location upstream of and away from first filtering means, for filtering out foreign matter of a particle size of more than 10 microns mixed in said slurry.

30. The slurry recycling system for a CMP apparatus as set forth in claim 28, further comprising a concentration adjusting means for adjusting the concentration of abrasives in said slurry to substantially an initial value before use.

31. The slurry recycling system for a CMP apparatus as set forth in claim 30, further comprising a second filtering means, disposed at a location upstream of and away from first filtering means, for filtering out foreign matter of a particle size of more than 10 microns mixed in said slurry.

32. The slurry recycling method for a CMP apparatus as set forth in claim 28 wherein said deionizer comprises an ion exchange resin.

33. The slurry recycling method for a CMP apparatus as set forth in claim 28 wherein said deionizer comprises an ion exchange film.

34. The slurry recycling method for a CMP apparatus as set forth in claim 28 wherein said slurry comprises a fumed particulate powder of silica alumina, zirconia, ceria, titania, or other metal oxides dispersed colloidally in one of water and an organic solvent.

35. The slurry recycling system for a CMP apparatus as set forth in claim 28 wherein said slurry comprises colloidal silica, colloidal alumina, colloidal zirconia, colloidal ceria, or colloidal titania produced from at least one of an aqueous solution of an inorganic metal salt or a solution of an organic metal salt capable of producing silica, alumina, zirconia, ceria, or titania.

36. The slurry recycling system for a CMP apparatus as set forth in claim 28 wherein said slurry comprises a sintered powder of alumina, zirconia, ceria, manganese oxide, or other metal oxides dispersed colloidally in one of water and an organic solvent.

* * * * *